US005751106A

United States Patent [19]

Mihira et al.

[11] Patent Number: 5,751,106

[45] Date of Patent: May 12, 1998

[54] FLUORESCENT DISPLAY TUBE

[75] Inventors: Akihiro Mihira; Tadashi Mizohata, both of Mobara, Japan

[73] Assignee: Futaba Denshi Kogyo K.K., Mobara, Japan

[21] Appl. No.: 768,628

[22] Filed: Dec. 18, 1996

[30] Foreign Application Priority Data

Dec. 22, 1995 [JP] Japan ..... 7-335005

[51] Int. Cl.[6] ..... H01J 19/00

[52] U.S. Cl. ..... 313/495; 313/497; 313/466

[58] Field of Search ..... 313/497, 495, 313/496, 466

[56] References Cited

U.S. PATENT DOCUMENTS

| | | | |
|---|---|---|---|
| 4,218,636 | 8/1980 | Miyazawa | 313/497 X |
| 4,472,658 | 9/1984 | Morimoto et al. | 313/497 |
| 4,551,652 | 11/1985 | Compen et al. | 313/466 |
| 4,666,548 | 5/1987 | Eto et al. | 313/497 X |
| 4,717,856 | 1/1988 | Kato | 313/466 |

FOREIGN PATENT DOCUMENTS 7-130307 5/1995 Japan .

*Primary Examiner*—Ashok Patel

*Attorney, Agent, or Firm*—Oblon, Spivak, McClelland, Maier & Neustadt, P.C.

[57] ABSTRACT

A fluorescent display tube has high visibility because reflection of Al of an anode conductor is prevented. A black film 3 formed on the inner surface of a substrate 2 is formed such that an inorganic metal containing compound is changed into a metal oxide by heat treatment, and consists of a $TaO_2$—, $Tl_2O$—, SnO—, or (Mn, Cu)—based oxide. An $SiO_2$ film 4 serving as an alkali-shielding film is formed on the inner surface of the substrate 2 to cover the black film 3. An anode conductor 5 consisting of Al is formed on the $SiO_2$ film 4. The anode conductor 5 is constituted of a frame member 6 and a stripe-shaped display unit 7 with transparency. The frame member 6 is behind the black film. The display unit 7 is partitioned by the inner edge of the gap between the black films 3. A phosphor layer 8 is formed on the display unit 7. A cross layer 9 is formed to cover the $SiO_2$ film 4. Light emitted from the phosphor layer 8 is partitioned with respect to the appearance of the light and observed through the substrate 2. Due to the black film, the reflectance of the Al film is low, i.e., 10% or less at 530 nm. Good contrast can be obtained, and a display unit can be read easily.

3 Claims, 2 Drawing Sheets

FLUORESCENT DISPLAY TUBE

BACKGROUND OF THE INVENTION

1. Field of the Invention

The present invention relates to a fluorescent display tube having an anti-reflection layer using an inorganic metal containing compound which is made black by a heat treatment and an alkali-shielding film consisting of an $SiO_2$ film.

2. Description of the Related Art

FIG. 1 is a sectional view showing a structure of an anode substrate of a conventional fluorescent display tube proposed in Japanese Patent Application No. 5-272172 (Japanese Unexamined Patent Publication No. 7-130307). An $SiO_2$ film 101 serving as an alkali-shielding film and a (Ti—Si)$O_2$ film 102 to be an anti-reflection film are sequentially laminated on a soda-lime substrate 100. An anode conductor 103 consisting of Al is formed on the (Ti—Si)$\mathbf{0}_2$ film 102. The anode conductor 103 is constituted of a frame member 104 and a display unit 105 formed in the frame member 104 in the form of stripes and having transparency. A cross layer 106 is formed on the frame member 104, and a phosphor layer 107 is formed on the display unit 105.

In the steps of manufacturing the anode substrate, by heat energy in printing the cross layer 106 to be sintered, an oxidation-reduction reaction occurs on the interface between Al constituting the anode conductor 103 and the (Ti—Si)$O_2$ film 102, and the (Ti-Si)$O_2$ film 102 is changed into a (Ti—Si)$O_{2-x}$ film to be colored, thereby obtaining an anti-reflection function.

Light emission of the phosphor layer 107 is observed from the outside of the soda-lime substrate 100 through the display unit 105 of the anode conductor 103, the (Ti—Si)$O_2$ film 102 serving as an anti-reflection film, the $SiO_2$ film 101, and the soda-lime substrate 100.

In the anode substrate of the conventional fluorescent display tube described above, when the display unit 105 of the anode conductor 103 is observed from the outside of the soda-lime substrate 100, the reflectance of the anode conductor 103 consisting of Al is about 35% at 530 nm, and the anti-reflection effect is not perfect.

SUMMARY OF THE INVENTION

It is an object of the present invention to provide a fluorescent display tube which has high visibility because the reflection of an anode conductor composed of Al is prevented and which has the same effect as that of an alkali-shielding film for a soda-lime glass.

A fluorescent display tube according to the first aspect of the present invention is characterized by comprising: a transparent substrate; a black film formed on a portion other than a display area of an inner surface of the substrate and containing an organic metal which is made black by sintering; a $SiO_2$ film formed on the approximately entire inner surface of the substrate to cover the black film; a frame member consisting of Al and formed on the $SiO_2$ film to be shielded by the black film when viewed from outside of the substrate; a transparent display unit consisting of Al and formed in the display area observed from a gap between the black films through the substrate and the $SiO_2$ film to be connected to the frame member when viewed from outside of the substrate; and a phosphor layer formed on the display unit.

A fluorescent display tube according to the second aspect of the present invention is characterized in that, in the fluorescent display tube according to the first aspect, the organic metal which is made black by sintering is an oxide arbitrarily selected from a group consisting of $TaO_2$—, $Tl_2O$—, SnO—, and (Mn, Cu)—based oxides.

DESCRIPTION OF THE PREFERRED EMBODIMENT

An embodiment of the present invention will be described below with reference to FIG. 2. This embodiments is related to a so-called front-light-emission type fluorescent display tube 1 in which light emission from en anode formed inside of a transparent substrate is observed from the outside of the substrate through an anode conductor having transparency and the substrate.

Figure 1:
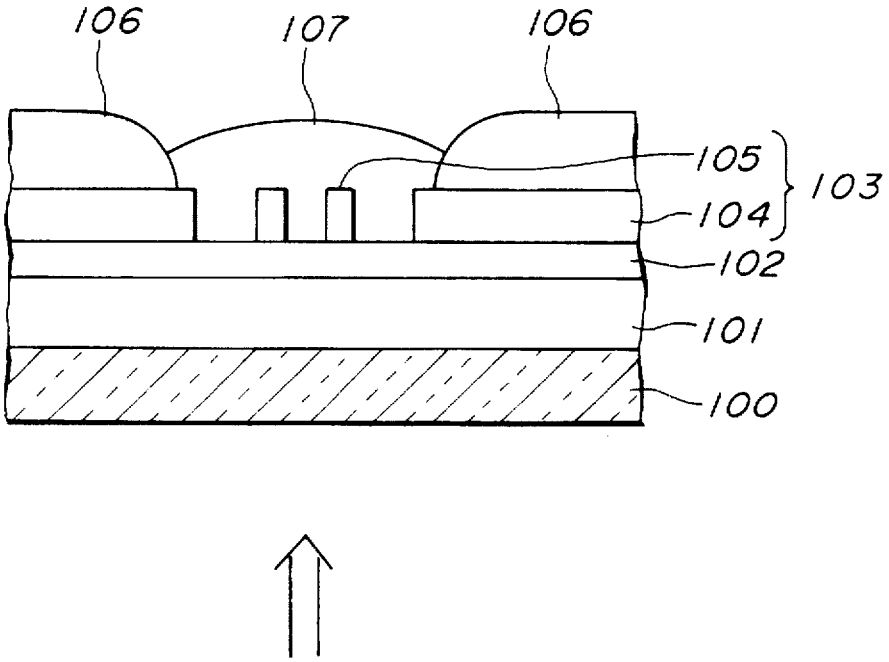
FIG.1 (PRIOR ART)
FIG. 1 is a sectional view showing a conventional fluorescent display tube.
Figure 2:
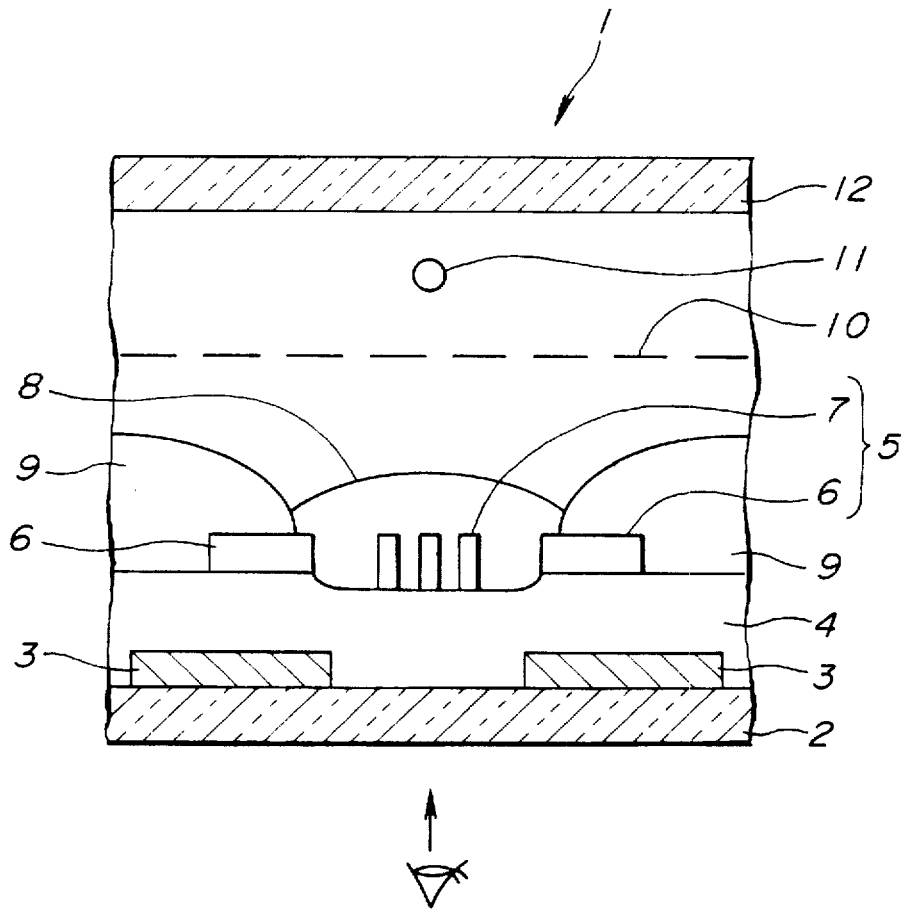
FIG. 2 is a sectional view showing an embodiment of the present invention.

As shown in FIG. 2, a black film 3 is formed on the inner surface of a substrate 2 serving as a transparent insulating substrate and consisting of a soda-lime glass. The black film 3 is obtained such that a heat treatment such as sintering is performed to an inorganic metal containing compound coated on the substrate 2 to be changed into a metal oxide. For example, the black film 3 consists of a $TaO_2$—, $Tl_2O$—, SnO—, or (Mn, Cu)—based oxide. The black film 3 partitions an outer edge of a display pattern of the anode, and a gap portion surrounded by the black film 3 corresponds to the display pattern.

Since the black film 3 consists of an inorganic metal containing compound, the thickness of the black film 3 can be decreased to about 1,000 to 2,000 Å. Note that, when the black film is formed by using a pigment, the thickness of the black film is to be 10 μm or more in consideration of the particle size of the pigment.

An $SiO_2$ film 4 serving as an alkali-shielding film is formed on the approximately entire inner surface of the substrate 2 to cover the black film 3. The $SiO_2$ film 4 is free from chlorine unlike a conventional $SiO_2$ film. Chlorine in the $SiO_2$ film attracts Na ions in the substrate 2 in the sintering step, and the Na ions reduce PbO in a cross layer to precipitate Pb in the form of tree branches, thereby posing a problem such as a so-called lead tree. For this reason, according to this embodiment, when an $SiO_2$ formation solution is to be manufactured, the hydrolysis step for a source material using HCl is not performed to prevent Cl from being left as a contamination material in a product.

More specifically, water is added to tetraethoxy silane monomer $(C_2O_5O)_4Si$, and an acid free from Cl, e.g., an organic acid such as propionic acid or acetic acid is added as a catalyst for accelerating a hydrolysis reaction and a condensation reaction. These reactions are performed while the resultant solution is stirred at room temperature to obtain a formation solution. This solution is coated on the substrate 2 by using a roll coater or the like to form a film, and the film is dried and then sintered at a temperature of about 500° C. The organic acid contained in the formation solution is burnt to be decomposed, thereby obtaining an alkali-shielding film consisting of an organic $SiO_2$ polymer free from Cl on the surface of the substrate 2.

The thickness of the $SiO_2$ film 4 is set to 1,000 to 2,000 Å in this embodiment. This thickness can be adjusted by the viscosity of the formation solution. The film thickness increases with an increase in viscosity of the formation solution, and the film thickness decreases with a decrease in viscosity.

An anode conductor 5 consisting of Al is formed on the $SiO_2$ film 4. The anode conductor 5 is constituted of a frame member 6 and a display unit 7 formed inside of the frame member 6 in the shape of stripes together with the frame member 6 to have transparency. When this structure is viewed from the outside of the substrate 2, the frame member 6 is shielded by the black film 3, and is arranged at a position behind the black film 3. More specifically, the frame member 6 has a size slightly larger than that of the outer edge of the display pattern, and is formed at a position where the frame member 6 is concealed by the black film 3. The display pattern is partitioned by the inner edge of the gap between the black films 3. When the structure is viewed from the outside of the substrate 2, the display unit 7 is arranged at a position where it is observed from the gap portion between the black films 3 through the substrate 2 and the $SiO_2$ film 4. A phosphor layer 8 is formed on the display unit 7. The phosphor layer 8 is arranged to have an outer edge which is in contact with at least the inner edge of the frame member 6 or partially overlaps the frame member 6.

A cross layer 9 is formed to cover the $SiO_2$ film 4. The cross layer 9 partially overlaps the frame member 6 of the anode conductor 5.

A control electrode 10 is formed above the substrate 2 in the above arrangement, and a filament-shaped cathode 11 serving as an electron source extends above the control electrode 10. A vessel portion is sealed on the upper surface of the substrate 2 to cover these various electrodes. Reference numeral 12 in FIG. 2 denotes a rear-surface substrate partially constituting the vessel portion.

In the fluorescent display tube 1 with the above arrangement, electrons emitted from the cathode 11 are accelerated/controlled by the control electrode 10, attracted by the anode conductor 5 to which an appropriate anode voltage is applied, and incident on the phosphor layer 8 to cause the phosphor layer 8 to emit light. Light emitted from the phosphor layer 8 passes through the transparent display unit 7 and the $SiO_2$ film 4, and is shaped by the black film 3 into a predetermined shape, and passes through the substrate 2 to be observed. More specifically, since the outer shape of the display unit 7 which emits light is partitioned, the precision of the shape of the display unit 7 is high. The black film 3 is formed on a portion except for the display unit 7, i.e., a portion which surrounds at least the display unit 7 and is closest to the display unit 7. For this reason, on the frame member 6 of the anode conductor 5 corresponding to this portion, the reflectance of the Al film is low, i.e., 10% or less at 530 nm. Therefore, observation is less prevented by reflection of external light. Since the color of the black film 3 is of the same type of that of the cross layer 9, the display unit 7 is viewed more easily than a conventional one, and the appearance of the fluorescent display tube 1 is more excellent. Since the width of each Al stripe of the display unit 7 is small, i.e., 20 to 40 μm, a problem related to reflection or the like is not posed even if no black film is formed under the display unit 7.

The steps of manufacturing the substrate 2 in the steps of manufacturing the fluorescent display tube 1 will be described below. A paste containing an inorganic metal containing compound is printed on the inner surface of the substrate 2 by means of screen printing or the like with a predetermined pattern and a predetermined thickness. This pattern is used to partition the outer edge of the display unit 7, and is formed at required precision, e.g., a repetition precision of ±10 μm. The substrate 2 is sintered at a temperature of about 300° C. In the first sintering step, the organic metal is not completely oxidized.

On the inorganic metal containing compound, the $SiO_2$ formation solution is coated by means of a roll coater method or the like with a predetermined thickness. Since the inorganic metal containing compound is not completely oxidized, the inorganic metal containing compound sticks to an organic metal in the $SiO_2$ solution, the $SiO_2$ film 4 and the black film 3 which are produced in the following steps are not easily peeled from each other. Even if the $SiO_2$ formation solution is printed to overlap the inorganic metal containing compound layer, the inorganic metal containing compound layer is not easily cracked because the inorganic metal containing compound layer is not completely oxidized.

The substrate 2 is sintered at a temperature of about 500° C. In the second sintering step, the inorganic metal containing compound is completely oxidized to be a black layer, and the $SiO_2$ formation solution is also sintered to produce a transparent $SiO_2$ film. The black film 3 sufficiently sticks to the $SiO_2$ film 4, so that the black film 3 and the $SiO_2$ film 4 are not easily peeled from each other.

An Al thin film is formed on the $SiO_2$ film 4 by a sputtering method. This Al thin film is processed into the anode conductor 5 with a desired pattern having the frame member 6 and the display unit 7. Since the $SiO_2$ film 4 is transparent, the Al thin film can be patterned at a high precision by using the black film 3 under the Al thin film as a positioning mark. Note that, as described above, since the outer shape of the light emission portion is partitioned by the inner edge of the gap between the black films 3, the arrangement precision of the anode conductor 5 may be set to be lower than the positioning precision of the black film 3 without any problem.

A paste material for forming the cross layer 9 is coated on the $SiO_2$ film 4, and the phosphor layer 8 is formed on the display unit 7 to partially overlap the frame member 6 of the anode conductor 5. Thereafter, the substrate 2 is sintered to complete the cross layer 9 and the phosphor layer 8.

According to the method of manufacturing the substrate 2 in the fluorescent display tube 1 described above, the sintering process is divided into a plurality of steps. In the first sintering step, an inorganic metal containing compound is not completely oxidized and the inorganic metal containing compound pattern is prevented from being cracked after the $SiO_2$ formation solution is printed to overlap the inorganic metal containing compound pattern, thereby improving the sticking properties between the $SiO_2$ film 4 and the black film 3 which are formed in the following step. The inorganic metal containing compound is completely oxidized by the second sintering step to be the black film 3, and the $SiO_2$ film 4 is produced to extremely stack to the black film 3.

According to this embodiment, the $SiO_2$ film 4 free from Cl is effectively serves as an alkali-shielding film, and a inconvenience such as a lead tree which is a conventional problem can be eliminated when the $SiO_2$ film 4 is applied to the substrate 2 of the fluorescent display tube 1.

According to the fluorescent display tube of the present invention, an inorganic metal containing compound which is made black after heat treatment is used, a black layer is formed on a soda-lime substrate by patterning, and an $SiO_2$ film serving as an alkali-shielding film is laminated on the black layer. Thus, the following effects can be obtained.

1. The reflectance of Al constituting an anode conductor becomes 10% or less at 530 nm.

2. Good contrast can be obtained, and display segment can be read more easily.

3. A black film has a color which is of the same type of that of a cross layer, and has excellent appearance.

What is claimed is:

1. A fluorescent display tube comprising:

a transparent glass substrate;

a black metal oxide thin film having thickness of within the range of 1000 Å–2000 Å formed on a portion other than a display area of an inner surface of said substrate, said black metal oxide thin film being formed by applying a film forming solution containing an organic metal compound on said substrate and subjecting said solution to a heat treatment;

an alkali-shielding film formed on the entire inner surface of said glass substrate covering said black metal oxide thin film;

anode conductors made of Al for delineating said display area, said anode conductors being formed on said alkali-shielding film at the positions corresponding to said black metal oxide thin film so as to be shielded by said black metal oxide thin film and permit said display area to be observed from a gap between said black metal oxide thin films through said glass substrate and alkali-shielding film when viewed said display area from outside of said substrate; and a phosphor layer formed on said display area.

2. A fluorescent display tube as defined in claim 1, wherein said black metal oxide thin film is selected from the group consisting of $TaO_2$, $Tl_2O_2$, SnO, and (Mn, Cu) based oxides.

3. A fluorescent display tube as defined in claim 1, wherein said alkali-shielding film is $SiO_2$ film.

* * * * *